US008894115B2

(12) United States Patent
Lundman

(10) Patent No.: US 8,894,115 B2
(45) Date of Patent: Nov. 25, 2014

(54) INFLATABLE LIFT CYLINDER

(71) Applicant: Philip L. Lundman, Fredonia, WI (US)

(72) Inventor: Philip L. Lundman, Fredonia, WI (US)

( * ) Notice: Subject to any disclaimer, the term of this patent is extended or adjusted under 35 U.S.C. 154(b) by 0 days.

(21) Appl. No.: 13/836,315

(22) Filed: Mar. 15, 2013

(65) Prior Publication Data

US 2014/0169928 A1 Jun. 19, 2014

Related U.S. Application Data

(60) Provisional application No. 61/737,366, filed on Dec. 14, 2012.

(51) Int. Cl.
*B66C 1/46* (2006.01)
*B66C 1/56* (2006.01)
*B66D 1/60* (2006.01)

(52) U.S. Cl.
CPC ... *B66C 1/56* (2013.01); *B66C 1/46* (2013.01); *B66D 1/60* (2013.01)
USPC ..... 294/98.1; 294/119.3

(58) Field of Classification Search
CPC ..... B66C 1/46; B66C 1/56; B25J 15/0023; B25J 15/0047; B25J 9/142; B65G 47/908
USPC ..... 294/63.2, 86.24, 98.1, 119.3; 279/2.08; 138/93
See application file for complete search history.

(56) References Cited

U.S. PATENT DOCUMENTS

| | | | | |
|---|---|---|---|---|
| 2,752,191 | A * | 6/1956 | Pierce | 294/98.1 |
| 3,375,034 | A * | 3/1968 | Blacksher | 294/86.24 |
| 3,741,409 | A * | 6/1973 | Painter | 414/733 |
| 3,892,437 | A * | 7/1975 | Makinen | 294/98.1 |
| 3,895,482 | A * | 7/1975 | Schulz et al. | 57/275 |
| 4,006,930 | A * | 2/1977 | Cawley et al. | 294/98.1 |
| 4,320,915 | A * | 3/1982 | Abbott et al. | 294/96 |
| 5,090,758 | A * | 2/1992 | Lord | 294/98.1 |
| 7,455,077 | B2 | 11/2008 | Lundman | |
| 2010/0202837 | A1 * | 8/2010 | Hoopman | 405/154.1 |

* cited by examiner

*Primary Examiner* — Dean Kramer

(74) *Attorney, Agent, or Firm* — Michael Best & Friedrich LLP

(57) ABSTRACT

A method of handling a generally cylindrical conduit includes positioning a lift cylinder within the generally cylindrical conduit. The lift cylinder includes an inflatable bag, an inflation port, and an attachment point. The method also includes connecting a fluid source to the inflation port, inflating the inflatable bag with the fluid source such that an outer surface of the inflatable bag engages an inner surface of the generally cylindrical conduit, connecting a winch to the attachment point, and moving the lift cylinder and the generally cylindrical conduit with the winch.

20 Claims, 5 Drawing Sheets

INFLATABLE LIFT CYLINDER

CROSS-REFERENCE TO RELATED APPLICATIONS

This application claims priority to U.S. Provisional Patent Application No. 61/737,366, filed Dec. 14, 2012, the entire contents of which are incorporated by reference herein.

FIELD OF THE INVENTION

The present invention relates to inflatable devices and, more particularly, to inflatable lift cylinders used to move loads such as pipes or other types of conduits.

SUMMARY

Embodiments of the invention provide a system and method for handling a pipe or other article, such as a section of a water pipeline, gas line, sewer line, or other conduit with an internal cylindrical, rectangular, or flat surface that an inflatable bag can be expanded against. The system includes an inflatable bag that is positioned within the pipe and then inflated to grip an inner surface of the pipe. Once the bag engages the pipe with sufficient force, the bag can be lifted, pulled, or otherwise moved to move the pipe and/or align the pipe with other structures. In some situations, the system may be used to handle other types of hollow, generally cylindrical equipment or loads, such as transformers or tanks (e.g., open-top concrete or metal tanks).

In one embodiment, the invention provides a method of handling a generally cylindrical conduit. The method includes positioning a lift cylinder within the generally cylindrical conduit. The lift cylinder includes an inflatable bag, an inflation port, and an attachment point. The method also includes connecting a fluid source to the inflation port, inflating the inflatable bag with the fluid source such that an outer surface of the inflatable bag engages an inner surface of the generally cylindrical conduit, connecting a winch to the attachment point, and moving the lift cylinder and the generally cylindrical conduit with the winch.

In another embodiment, the invention provides a method of handling a pipe. The method includes positioning an inflatable bag within the pipe, inflating the inflatable bag such that an outer surface of the inflatable bag engages an inner surface of the pipe, and pulling the inflatable bag to lift the pipe.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
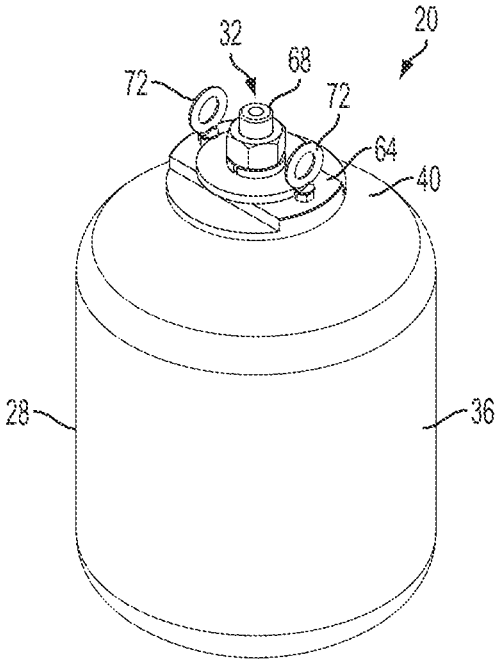
FIG. 1 is a perspective view of an inflatable lift cylinder embodying the invention.
Figure 2:
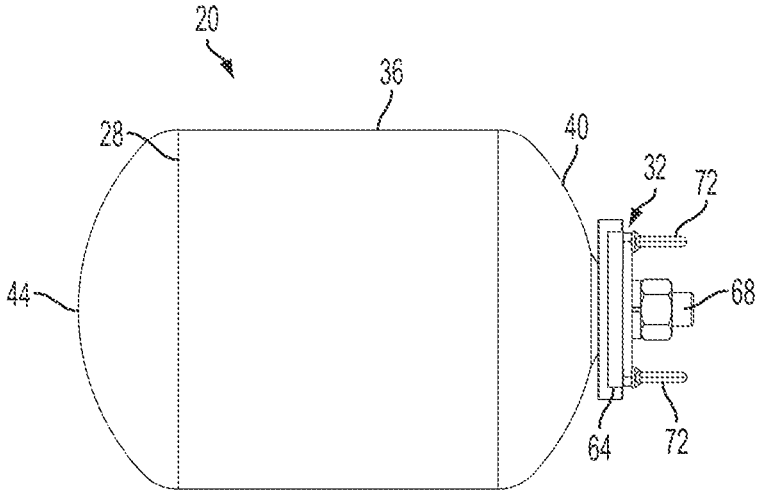
FIG. 2 is a side view of the inflatable lift cylinder.
Figure 5:
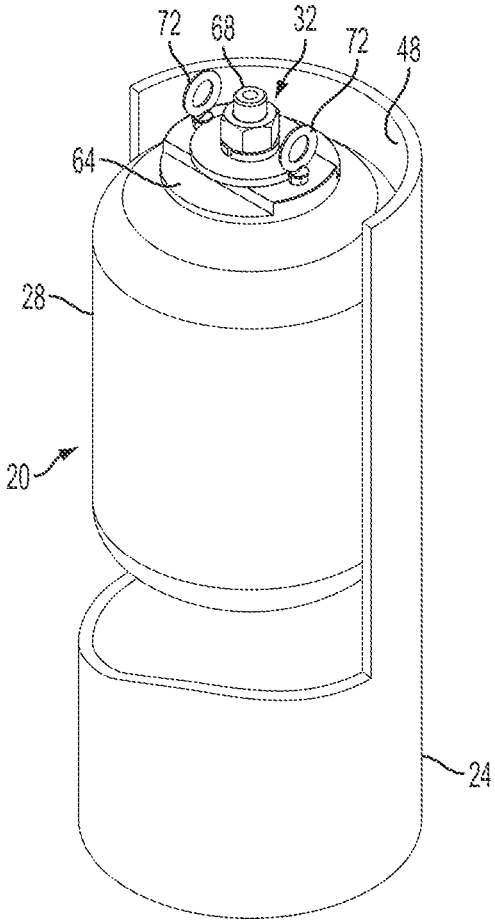
FIG. 5 is a perspective view of the inflatable lift cylinder positioned within a pipe.
Figure 6:
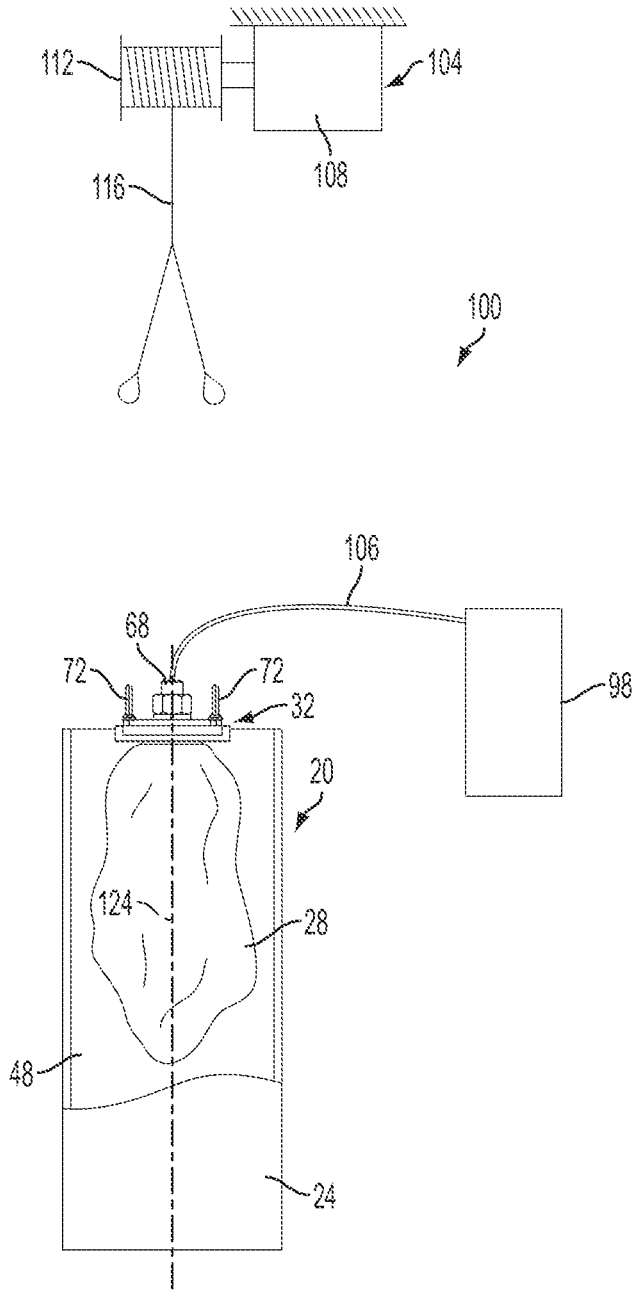
FIG. 6 illustrates a system for lifting the pipe, the system including a fluid source, a winch, and the inflatable lift cylinder in a deflated state.
Figure 7:
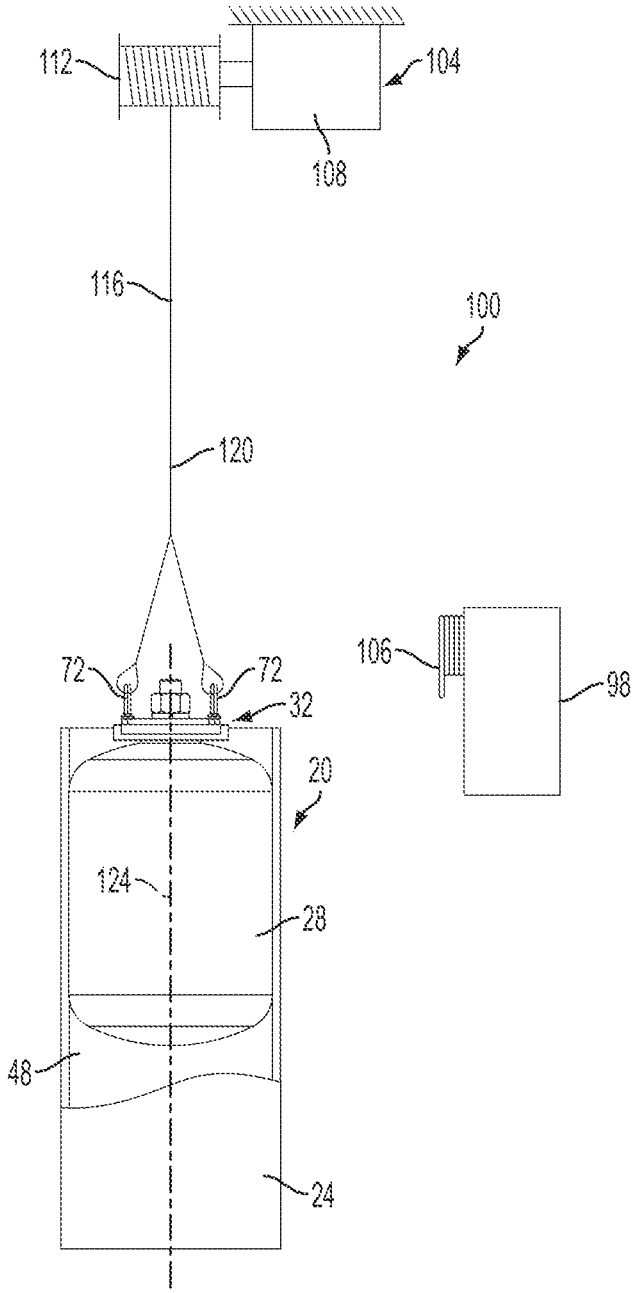
FIG. 7 illustrates the system for lifting the pipe with the inflatable lift cylinder in an inflated state.

FIGS. 1 and 2 illustrate an inflatable lift cylinder 20 for handling a pipe 24 (FIGS. 5-7). In other embodiments, the lift cylinder 20 may be used to handle other types of loads having an internal space and an inner cylindrical, rectangular, or flat surface suitable for applying a friction force. The illustrated lift cylinder 20 includes an inflatable bag 28 and a connection portion 32 coupled to the bag 28. The bag 28 is initially deflated to fit inside the pipe 24, but may be inflated with a suitable fluid, such as nitrogen or ambient air. When inflated (as shown in FIGS. 1 and 2), the bag 28 is generally cylindrical and includes an outer circumferential surface 36, a first end 40, and a second end 44. The first and second ends 40, 44 are positioned on opposing sides of the outer surface 36, and the outer surface 36 extends continuously between the ends 40, 44. As further discussed below, the outer surface 36 is configured to grip an inner surface 48 of the pipe 24 so that moving the lift cylinder 20 also moves the pipe 24.

Figure 4:
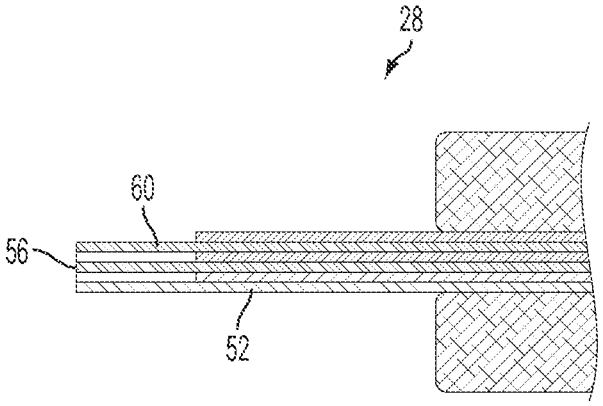
FIG. 4 is an enlarged cross-sectional view of a portion of a bag of the inflatable lift cylinder.

As shown in FIG. 4, the bag 28 is composed of a plurality of plies or layers 52, 56, 60. In the illustrated embodiment, the bag 28 is composed of three plies 52, 56, 60. The first, or inner, ply 52 includes a welded polyurethane film bladder. The second, or middle, ply 56 includes sewn 1050 ballistic nylon. The third, or outer, ply 60 includes polyurethane coated 1050 ballistic nylon. The polyurethane coating of the third ply 60 faces outward from the bag 28 and forms at least part of the outer surface 36 of the bag 28. In other embodiments, other suitable materials (e.g., fabrics, rubbers, etc.) may be used to form the plies 52, 56, 60 and/or the bag 28 may be composed of fewer or more plies.

Figure 3:
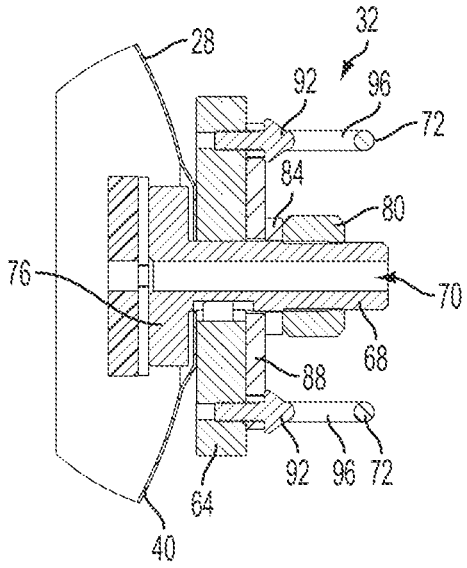
FIG. 3 is an enlarged cross-sectional view of a connection portion of the inflatable lift cylinder.

Referring to FIG. 3, the connection portion 32 is positioned on the first end 40 of the bag 28. The illustrated connection portion 32 includes a flange 64, an inflation port 68, and two connectors 72. The flange 64 is secured to the first end 40 of the bag 28 by the inflation port 68. The illustrated flange 64 is generally disc-shaped and composed of metal, such as steel. In other embodiments, the flange 64 may be composed of other high-strength materials and/or may be a different shape.

The inflation port 68 is supported on the first end 40 of the bag 28 by the flange 64. The inflation port 68 defines a conduit 70 that communicates with the interior of the bag 28 to inflate and deflate the bag 28. As shown in FIG. 3, the inflation port 68 extends through the flange 64 such that a portion of the bag 28 is captured or sandwiched between a large diameter portion 76 of the inflation port 68 and the flange 64. In the illustrated embodiment, the large diameter portion 76 of the inflation port 68 is positioned inside the bag 28, while the flange 64 is positioned outside of the bag 28. In other embodiments, the relative positions of the flange 64 and the large diameter portion 76 may be reversed. The illustrated inflation port 68 is secured to the flange 64 by a threaded fastener 80, such as a hex nut. In other embodiments, the inflation port 68 may be secured to the flange 64 using other suitable coupling means. By securing the inflation port 68 to the flange 64, the connection portion 32 is also secured to the bag 28.

A first, small diameter washer 84 and a second, large diameter washer or seal 88 are positioned between the threaded fastener 80 and the flange 64. The first washer 84 has an outer diameter generally equal to an outer diameter of the threaded fastener 80. The second washer 88 has an outer diameter that is greater than a diameter of the large diameter portion 76 of the inflation port 68, but smaller than an outer diameter of the flange 64. The washers 84, 88 facilitate securing the inflation port 68 to the flange 64, and thereby securing the connection portion 32 to the bag 28.

The connectors 72, or attachment points, are coupled to the flange 64 and extend outwardly from the first end 40 of the bag 28. In the illustrated embodiment, the connectors 72 are lift lugs that thread into openings in flange 64. The connectors 72 may be further secured within the openings using adhesive. Each of the illustrated connectors 72 includes a shoulder portion 92 and an eye hole 96. The shoulder portions 92 are shaped and sized to engage the second washer 88 when the connectors 72 are threaded into the flange 64. The eye holes 96 receive a cable, wire, rope, chain, clip, or other structure to facilitate pulling or lifting the bag 28. In the illustrated embodiment, the connection portion 32 includes two connectors 72 positioned around the inflation port 68 on diametrically opposed sides of the flange 64. The connectors 72 are equally spaced apart on opposite sides of a central longitudinal axis 124 (FIGS. 6 and 7) and center of gravity of the lift cylinder 20. In other embodiments, the connection portion 32 may include fewer or more connectors 72 that are spaced apart on the flange 64.

As shown in FIG. 5, the inflatable lift cylinder 20 is positioned within the pipe 24. A portion of the pipe 24 is removed in the drawing to help illustrate the lift cylinder 20. The lift cylinder 20 is initially positioned in the pipe 24 when the bag 28 is deflated (as shown in FIG. 6). Once the lift cylinder 20 is properly positioned, the bag 28 can be inflated by connecting a fluid source 98 (FIGS. 6 and 7), such as an air pump, to the inflation port 68. Fluid is then pumped or otherwise driven into the bag 28 to inflate the bag 28. When inflated, the bag 28 has an outer diameter that is generally equal to or larger than an inner diameter of the pipe 24 such that the outer surface 36 of the bag 28 engages the inner surface 48 of the pipe 24. The shape and size of the inflatable bag 28 may be varied depending on the shape and size of the pipe 24, or other structure, being handled by the lift cylinder 20.

The outer surface 36 of the inflated bag 28 grips the inner surface 48 of pipe 24 with sufficient force so that moving the lift cylinder 20 also moves the pipe 24. The force is created by friction between the bag 28 and the pipe 24. The amount of friction is determined by the material on the outer surface 36 of the bag 28, the inflation pressure of the bag 28, the size (e.g., diameter) of the bag 28, and the area or length of contact between the bag 28 and the pipe 24. In some embodiments, the desired inflation pressure and size of the bag 28 are calculated based on the weight of the pipe 24. In some embodiments, the lift cylinder 20 may be used to lift pipes up to 250 pounds or more.

As noted above, the outer ply 60 of the bag 28 is coated with urethane, which helps increase the friction force between the bag 28 and the pipe 24 and reduces the possibility of damaging the inner surface 48 of the pipe 24. In other embodiments, the outer ply 60 of the bag 28 may be coated with other rubber products to increase the friction force and/or to address chemical requirements of the pipe 24. Urethane, and other types of rubbers, provides the outer surface 36 of the bag 28 with a high coefficient of friction. In further embodiments, the outer ply 60 of the bag 28 may be coated with other chemicals, such as silicon or Teflon, during, for example, high temperature scenarios. In such embodiments, the bag 28 may require a relatively higher inflation pressure or larger contact area to achieve sufficient gripping force.

FIGS. 6 and 7 illustrate a system 100 for handling the pipe 24. The system 100 includes the inflatable lift cylinder 20, the fluid source 98, and a winch 104. As shown in FIG. 6, the fluid source 98 includes a hose 106, or other suitable conduit, that connects to the inflation port 68 of the lift cylinder 20. The fluid source 98 provides pressurized air, nitrogen, or other gas or fluid to the bag 28 through the inflation port 68, thereby inflating the bag 28 to a desired pressure.

After the bag 28 of the lift cylinder 20 is inflated, the winch 104 is connected to the lift cylinder 20 to move (e.g., lift) the cylinder 20 and the pipe 24, as shown in FIG. 7. In other embodiments, the lift cylinder 20 can be connected to the winch 104 before the bag 28 is inflated. Additionally or alternatively, other suitable lifting devices may also or alternatively be employed to move the lift cylinder 20 and the pipe 24.

The winch 104 includes a motor 108, a spool 112 driven by the motor 108, and a cable 116 that winds and unwinds from the spool 112. The cable 116 connects to the lift cylinder 20 via the lift lugs 72 extending from the first end 40 of the bag 28. Once the cable 116 is connected to the lugs 72, the bag 28 can be pulled by rotating the spool 112 to wind the cable 116. The winch 104 may be used to lift the pipe 24 vertically away from the ground or to pull the pipe 24 horizontally along or relative to the ground. After the pipe 24 is properly positioned, the bag 28 is deflated, removed from the pipe 24, and disconnected from the winch 104.

As shown in FIG. 7, the lift cylinder 20 is lifted or pulled generally along a lift axis 120 defined by the cable 116 of the winch 104. Due to the positioning of the lift lugs 72, the lift axis 120 is coaxial with a central longitudinal axis 124 of the pipe 24. The pipe axis 124 is also the central longitudinal axis 124 of the lift cylinder 20. The illustrated lift lugs 72 are positioned on diametrically opposite sides of the central longitudinal axis 124 to help balance the pipe 24 during lifting or other movements. In particular, the lift lugs 72 are positioned on opposite sides of the longitudinal axis 124 and are equally spaced apart from the longitudinal axis 124. The lift lugs 72 are also positioned inward of an outer periphery of the pipe 24 and of the bag 28. The illustrated inflation port 68 is generally aligned with the central longitudinal axis 124 such that the connection portion 32 is symmetrical about the axis 124. Such an arrangement of the lift lugs 72 helps balance the weight of the pipe 24 around the lift axis 120 to limit torque on the winch 104 when the lift cylinder 20 is being pulled along the lift axis 120. Such an arrangement also helps control the position of the pipe 24 relative to the winch 104 by reducing the tendency of the pipe 24 to swing on the cable 116.

The lift cylinder 20 thereby allows pipes, conduits, open tanks, and other equipment or apparatuses to be handled and carried from above. For example, a user can position the winch 104 generally above the pipe 24 (in a vertical direction relative to gravity) to lift the pipe 24 away from the ground (or a hole in the ground). Similarly, the winch 104 can be operated to lower the pipe 24 toward the ground (or into a hole in the ground). In some embodiments, a system of pulleys may be employed to direct the cable 116 above the pipe 24 without having to position the winch 104 itself above the pipe 24. As such, a user can pick up a pipe (or similar structure) without having to attach extra connectors directly on the pipe or to get underneath the pipe.

Various features and advantages of the invention are set forth in the following claims.

The invention claimed is:

1. A method of handling a generally cylindrical conduit having a central longitudinal axis, the method comprising:

positioning a lift cylinder within the generally cylindrical conduit, the lift cylinder including an inflatable bag, an inflation port, and an attachment point, the inflatable bag being substantially hollow from the central longitudinal axis of the generally cylindrical conduit to an inner surface of the inflatable bag, and wherein a volume of the inflatable bag passes through the central longitudinal axis;

connecting a fluid source to the inflation port;

inflating the inflatable bag with the fluid source such that an outer surface of the inflatable bag engages an inner surface of the generally cylindrical conduit;

connecting a winch to the attachment point; and moving the lift cylinder and the generally cylindrical conduit with the winch.

2. The method of claim 1, wherein moving the lift cylinder and the generally cylindrical conduit includes pulling the lift cylinder with the winch to lift the lift cylinder and the generally cylindrical conduit.

3. The method of claim 1, wherein moving the lift cylinder and the generally cylindrical conduit includes handling the generally cylindrical conduit from above the generally cylindrical conduit, in a vertical direction relative to gravity.

4. The method of claim 1, wherein moving the lift cylinder and the generally cylindrical conduit includes moving the lift cylinder and the generally cylindrical conduit generally along the central longitudinal axis.

5. The method of claim 4, wherein the attachment point is a first attachment point and the lift cylinder includes a second attachment point, and wherein the first and second attachment points are positioned on diametrically opposite sides of the central longitudinal axis.

6. The method of claim 5, wherein the first attachment point and the second attachment point are equally spaced apart from the central longitudinal axis.

7. The method of claim 1, wherein the inflatable bag includes a first end and a second end on opposing sides of the outer surface, and wherein the inflation port and the attachment point are positioned on the first end of the inflatable bag.

8. The method of claim 7, further comprising providing a flange on the first end of the inflatable bag, and wherein the inflation port extends through the flange and the attachment point extends from the flange.

9. The method of claim 1, wherein the attachment point is a lift lug, and wherein connecting the winch to the attachment point includes connecting a cable of the winch to the lift lug.

10. A method of handling a pipe having a central longitudinal axis, the method comprising:

positioning an inflatable bag within the pipe, the inflatable bag consisting essentially of one or more flexible layers;

inflating the inflatable bag such that an outer surface of the inflatable bag engages an inner surface of the pipe, wherein only fluid substantially fills a volume between an inner surface of the inflatable bag and the central longitudinal axis of the pipe, and wherein the volume passes through the central longitudinal axis; and pulling the inflatable bag to lift the pipe.

11. The method of claim 10, wherein pulling the inflatable bag includes handling the pipe from above the pipe, in a vertical direction relative to gravity.

12. The method of claim 10, wherein pulling the inflatable bag includes pulling the inflatable bag generally along the central longitudinal axis to lift the pipe.

13. The method of claim 12, wherein the inflatable bag includes a first end and a second end on opposing sides of the outer surface, and further comprising providing a flange on the first end of the inflatable bag, an inflation port extending through the flange in fluid communication with the inflatable bag, and two attachment points extending from the flange.

14. The method of claim 10, further comprising connecting a fluid source to the inflatable bag.

15. The method of claim 14, wherein inflating the inflatable bag includes inflating the inflatable bag with the fluid source.

16. The method of claim 15, wherein an inflation port extends from the inflatable bag, wherein connecting the fluid source to the inflatable bag includes connecting the fluid source to the inflation port, and wherein inflating the inflatable bag includes inflating the inflatable bag with the fluid source through the inflation port.

17. The method of claim 10, further comprising connecting a winch to the inflatable bag.

18. The method of claim 17, wherein pulling the inflatable bag includes pulling the inflatable bag with the winch to move the pipe.

19. The method of claim 18, wherein a connector extends from the inflatable bag, and wherein connecting the winch to the inflatable bag includes connecting a cable of the winch to the connector.

20. A method of handling a pipe, the method comprising:

positioning an inflatable bag within the pipe;

inflating the inflatable bag such that an outer surface of the inflatable bag engages an inner surface of the pipe; and pulling the inflatable bag to lift the pipe, wherein the pipe defines a central longitudinal axis, and wherein pulling the inflatable bag includes pulling the inflatable bag generally along the central longitudinal axis to lift the pipe, wherein the inflatable bag includes a first end and a second end on opposing sides of the outer surface, and further comprising providing a flange on the first end of the inflatable bag, an inflation port extending through the flange in fluid communication with the inflatable bag, and two attachment points extending from the flange, and wherein providing the inflation port includes aligning the inflation port with the central longitudinal axis of the pipe, and wherein providing the two attachment points includes positioning the two attachment points on diametrically opposite sides of the inflation port such that the two attachment points are equally spaced apart from the central longitudinal axis.

* * * * *